US007951096B2

(12) United States Patent
Ju et al.

(10) Patent No.: US 7,951,096 B2
(45) Date of Patent: May 31, 2011

(54) LIMB REHABILITATION APPARATUS WITH TORQUE DETECTOR

(75) Inventors: Ming-Shaung Ju, Tainan (TW); Chou-Ching Lin, Tainan (TW); Pin-Cheng Kung, Kaohsiung (TW)

(73) Assignee: National Cheng Kung University, Tainan (TW)

( * ) Notice: Subject to any disclaimer, the term of this patent is extended or adjusted under 35 U.S.C. 154(b) by 1017 days.

(21) Appl. No.: 11/750,049

(22) Filed: May 17, 2007

(65) Prior Publication Data

US 2008/0097255 A1 Apr. 24, 2008

(30) Foreign Application Priority Data

Oct. 20, 2006 (TW) ..... 95218629 U

(51) Int. Cl.
*A61H 1/00* (2006.01)

(52) U.S. Cl. ..... 601/5; 601/33

(58) Field of Classification Search ..... 601/5, 23, 601/24, 26, 27, 32, 33, 34, 40; 482/44, 45
See application file for complete search history.

(56) References Cited

U.S. PATENT DOCUMENTS

| | | | | |
|---|---|---|---|---|
| 1,573,571 | A * | 2/1926 | Pohl | 601/24 |
| 2,054,402 | A * | 9/1936 | Williams | 601/5 |
| 5,848,979 | A * | 12/1998 | Bonutti et al. | 601/5 |
| 7,204,814 | B2 * | 4/2007 | Peles | 601/5 |
| 2004/0153010 | A1 * | 8/2004 | Bonutti et al. | 601/5 |

* cited by examiner

*Primary Examiner* — Danton DeMille
(74) *Attorney, Agent, or Firm* — Bacon & Thomas, PLLC

(57) ABSTRACT

A rehabilitation apparatus is disclosed. The rehabilitation apparatus includes a supporting housing, a rotary housing, an actuator, a control unit, and a torque detector. The rotary housing is slidably mounted to the supporting housing to hold a body segment. The actuator has a driving shaft to rotate the rotary housing. The control unit is electrically connected to the actuator to control the actuation of the actuator. The torque detector is electrically connected to the control unit, thereby detecting a torque exerted on the driving shaft, and transmitting a torque signal to the control unit.

12 Claims, 5 Drawing Sheets

LIMB REHABILITATION APPARATUS WITH TORQUE DETECTOR

RELATED APPLICATIONS

This application claims priority to Taiwan Application Serial Number 95218629, filed Oct. 20, 2006, which is herein incorporated by reference.

FIELD OF THE INVENTION

This invention relates to a rehabilitation apparatus, and more particularly, to an apparatus that guides the user to perform rehabilitation movements.

BACKGROUND OF THE INVENTION

From clinical experience, movement disorders due to hemiplegia include reduced range of motion (ROM), weakness, hyperactive reflexes, incoordination, spasticity, and synergy patterns. Patients' daily activities are affected since these disorders do not allow patients voluntarily contract a single muscle group.

Conventionally, therapists would guide patients to perform continuously passive movements with bare hands or with assistive equipment. When patients perform continuously active movements, therapists apply adequate resistance or assistance to induce normal synergies. However, in one period of rehabilitation, therapists have to take a lot of time to guide patients to perform motion continuously and repeatedly. Therefore, the conventional rehabilitation is very laborious and time-consuming. Further, therapists' assessments of degree of rehabilitation are subjective, so that it is hard to objectively assess the degree of rehabilitation.

SUMMARY OF THE INVENTION

Therefore, an aspect of the present invention is to provide a rehabilitation apparatus to simulate the therapist's rehabilitation method and to continuously guide the user to perform the rehabilitation movements for a long time, thereby saving labor and time.

Another aspect of the present invention is to provide a rehabilitation apparatus to continuously record the torque between the user's body segment and the apparatus in the rehabilitation process, so as to asses the degree of rehabilitation, thereby setting up an objective quantitative index for clinical rehabilitation assessment, and to amend the rehabilitation movements according to the degree of rehabilitation.

Another aspect of the present invention is to provide a rehabilitation apparatus to the passive rehabilitation process or the active rehabilitation process, so as to raise the user's range of motion (ROM) and increase muscle strength, thereby reforming the user's movement disorders.

According to an embodiment of the present invention, the rehabilitation apparatus includes a supporting housing, a rotary housing, an actuator, a control unit, and a torque detector. The rotary housing is slidably mounted to the supporting housing, wherein the rotary housing has a engagement member and a gear-like portion, and the engagement member engages a body segment, and the gear-like portion is disposed around the rotary housing. The actuator is fixedly mounted to the supporting housing to rotate the rotary housing, wherein the actuator has a driving shaft and an actuating gear, and the actuating gear is disposed at one end of the driving shaft, and geared to the gear-like portion of the rotary housing. The control unit is electrically connected to the actuator, wherein the control unit controls the actuator to rotate the rotary housing. The torque detector is disposed in the supporting housing and is electrically connected to the control unit, thereby detecting the torque exerted on the driving shaft, and transmitting the torque signal to the control unit.

Therefore, the rehabilitation apparatus disclosed in the embodiments of the present invention can simulate the therapist's rehabilitation method and guide the user to perform the rehabilitation movements for long time, thereby saving labor and time. The torque between the body segment and the actuator can be recorded to assess the degree of rehabilitation. Besides, the rehabilitation process of the rehabilitation apparatus is determined by the degree of rehabilitation, thereby promoting the rehabilitation effect.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

In order to make the illustration of the present invention more explicit and complete, the following description is described with reference to FIG. 1 through FIG. 5.

Figure 1:
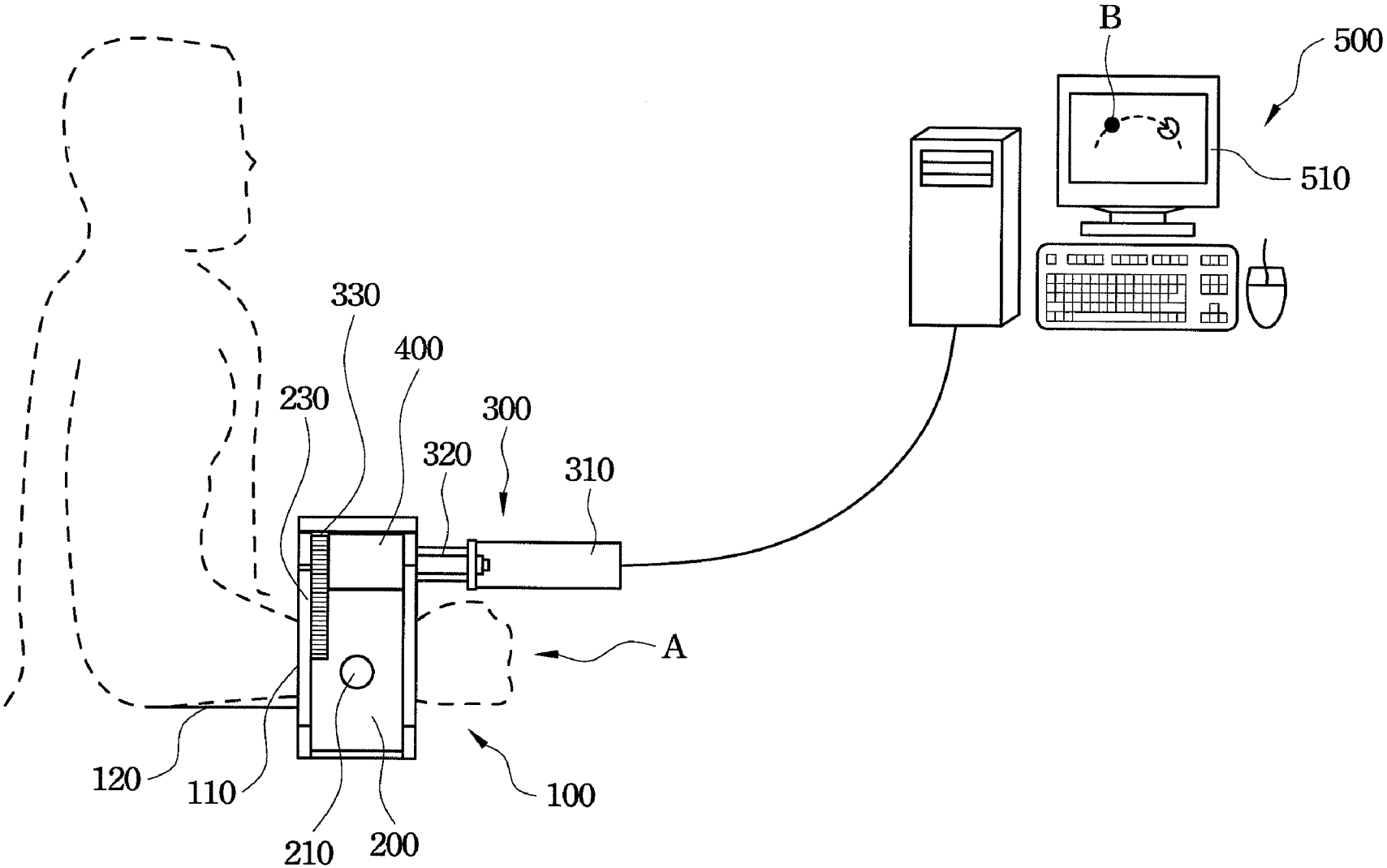
FIG. 1 is a side view of a rehabilitation apparatus according to a first embodiment of the present invention.

FIG. 1 is a side view of a rehabilitation apparatus according to a first embodiment of the present invention. The rehabilitation apparatus includes a supporting housing 100, a rotary housing 200, an actuator 300, a torque detector 400 and a control unit 500. The rotary housing 200 is slidably mounted to the supporting housing 100 and used for engaging and holding a user's body segment A (such as a stroke patient with movement disorders). The user can voluntarily rotate his body segment A engaged in the rotary housing 200 or let his body segment A be passively rotated by the rotary housing 200, thereby achieving rehabilitation effects. The actuator 300 is fixedly mounted to the supporting housing 100 to provide resistance or assistance of rehabilitation, thereby simulating the therapist's rehabilitation method. When users rotate their body segment A for rehabilitation, the torque detector 400 detects the torque input of the user's body segment A, and the degree of rehabilitation can be assessed objectively by the torque. The control unit 500 may control the actuator 300 to provide resistive or assistive torque thereby guiding the user to perform rehabilitation movements, and change the actuation mode of the actuator 300 according to the degree of rehabilitation that is assessed by the torque detected.

Figure 2:
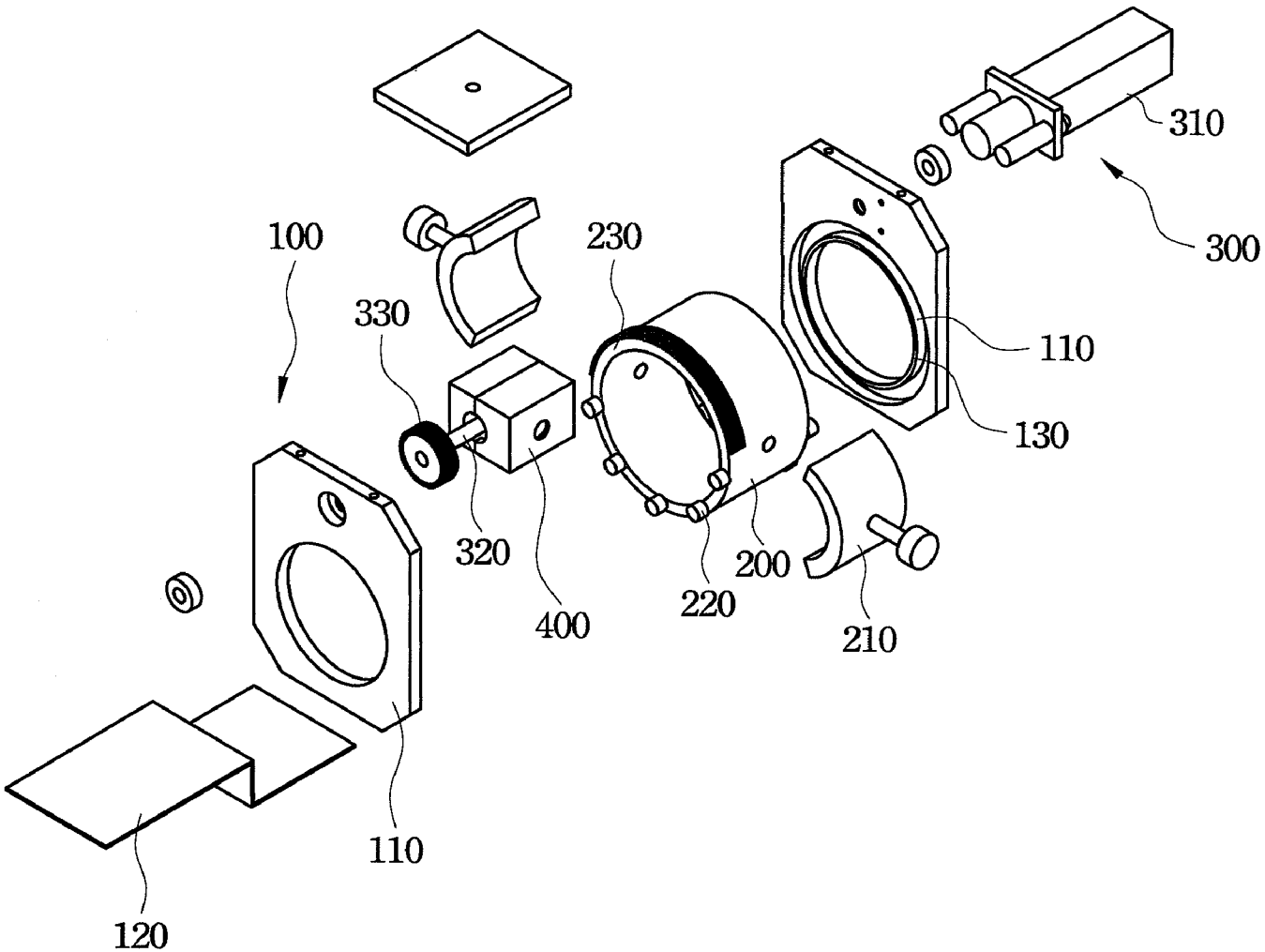
FIG. 2 is an exploded view of the rehabilitation apparatus of FIG. 1 of the present invention.

FIG. 2 is an exploded view of the rehabilitation apparatus of FIG. 1 of the present invention. As shown, the supporting housing 100 has two openings 110 and two annular grooves 130. The openings 110 are formed corresponding to both ends of the rotary housing 200 so that users can put their body segment A into the rotary housing 200 through the openings 110 of the supporting housing 100. Preferably, a holding plate 120 is disposed at the front of the openings 110 to support the user's body segment A, thereby reducing the user's discomfort when performing the rehabilitation movement. The annular grooves 130 are formed corresponding to and designed to receive both ends of the rotary housing 200 so that the rotary housing 200 is slidably mounted to the annular grooves 130 of the supporting housing 100 and capable of rotating relative to the supporting housing 100. Therefore, users can put their body segment A into the rotary housing 200 disposed in the supporting housing 100, and can rotate their body segment A relative to the supporting housing 100.

Figure 3:
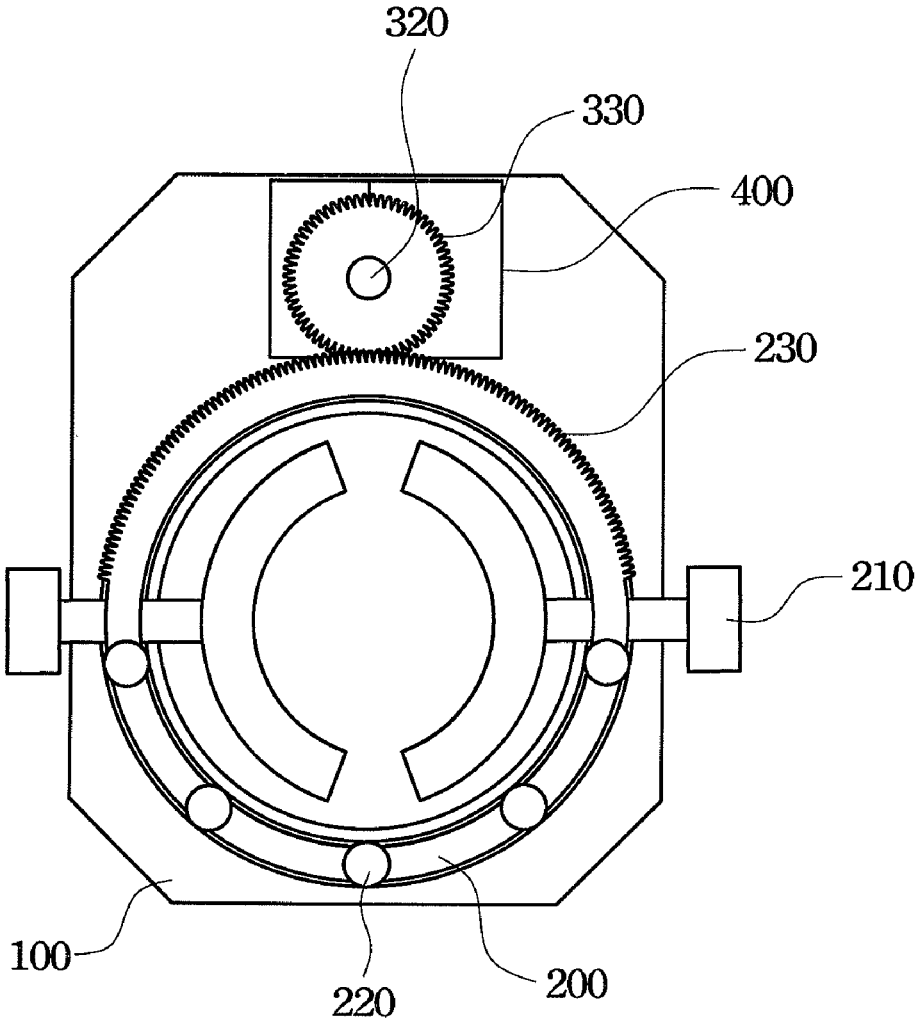
FIG. 3 is a cross-sectional view of the rehabilitation apparatus of FIG. 1 of the present invention.

FIG. 3 is a cross-sectional view of the rehabilitation apparatus of FIG. 1 of the present invention. As shown, the rotary housing 200 of this embodiment may be an annular housing which has at least an engagement member 210, a plurality of rollers 220 and a gear-like portion 230. The engagement member 210 is used for engaging the user's body segment A such that the body segment A can rotate together with the rotary housing 200 relative to the supporting housing 100. Preferably, a plurality of rollers 220 are provided on both ends of the rotary housing 200 and configured to be received in the annular grooves 130 of the supporting housing 100 so that the rotary housing 200 can rotate smoothly relative to the supporting housing 100. The gear-like portion 230 is formed on the outer surface of the rotary housing at a location corresponding to the actuator 300.

Referring to FIG. 2 again, the actuator 300 has a motor 310, a driving shaft 320 and an actuating gear 330. One end of the driving shaft 320 is connected to the motor 310 and rotated by the motor 310. The actuating gear 330 is disposed at the other end of the driving shaft 320 and geared to the gear-like portion 230 of the rotary housing 200. Therefore, when the motor 300 operates, the driving shaft 320 rotates the rotary housing 200. The actuator 300 is electrically connected to the control unit 500 and controlled by the control unit 500.

As shown in FIG. 1, the torque detector 400 is disposed in the supporting housing 100 and electrically connected to the control unit 500, and is used for detecting the torque applied to the driving shaft 320, and transmitting the torque signal to the control unit 500. The torque detector 400 has a plurality of ring portions 410 and a detecting circuit (not shown).

Specifically, the detecting circuit of the torque detector 400 may be formed on the driving shaft 320. The detecting circuit may be a full bridge circuit including a plurality of strain gauges to detect the strain of the driving shaft 320 due to the torque applied to the driving shaft 320 and output as a voltage signal so that the torque detector 400 can detect the torque.

Figure 4:
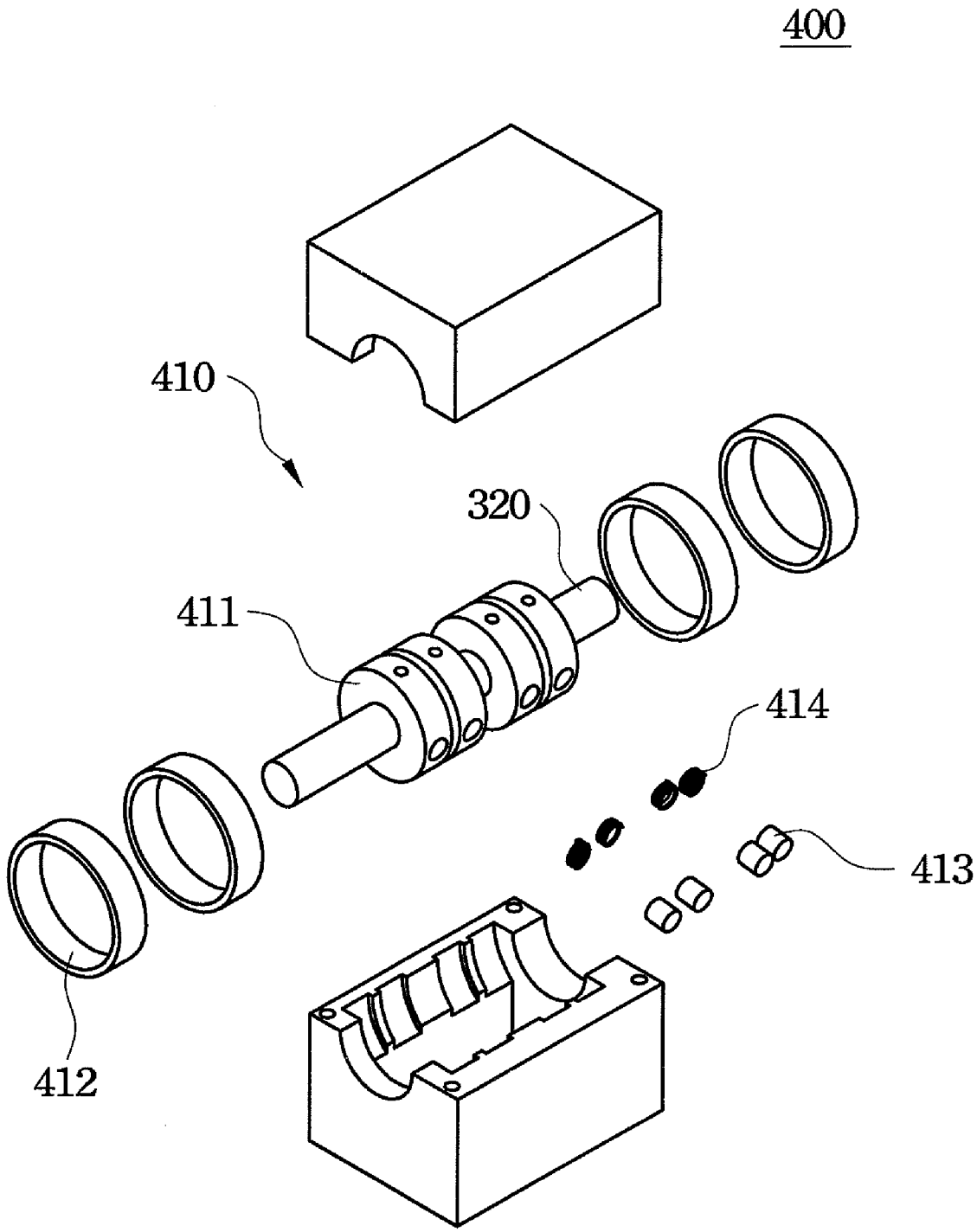
FIG. 4 is an exploded view showing the torque detector of the rehabilitation apparatus of FIG. 1 of the present invention.

FIG. 4 is an exploded view showing the torque detector 400 of the rehabilitation apparatus of FIG. 1. The torque detector 400 is provided with a plurality of ring portions 410 mounted around the driving shaft 320. Each of the ring portions 410 includes an inner ring 411, an outer ring 412, a conductive post 413 and an elastic element 414. The inner ring 411 is made of plastic material and sleeved on the driving shaft 320. The outer ring 412 is made of metallic material and sleeved on the inner ring 411. The conductive post 413 and the elastic element 414 are disposed vertically through the inner ring 411. The conductive post 413 is electrically connected to the detecting circuit, and the elastic element 414 is disposed below the conductive post 413 for biasing the conductive post 413 against the outer ring 412 that is electrically connected to the control unit 500. Therefore, the torque signal detected by the detecting circuit is transmitted to the control unit 500 through the conductive post 413 and the outer ring 412.

As shown in FIG. 1, the control unit 500 of this embodiment may be a programmable control chip or a computer apparatus. The control unit 500 can control the actuator 300 to rotate the rotary housing 200 in advance, so as to guide the user to perform the rehabilitation movements, or to change the actuation mode of the actuator 300 according to the degree of rehabilitation that is assessed by the torque detected. The control unit 500 may be provided with a display 510 to display a trace point B. The user can voluntarily perform some rehabilitation according the guidance of the trace point, thereby simulating the therapist's rehabilitation method.

Figure 5:
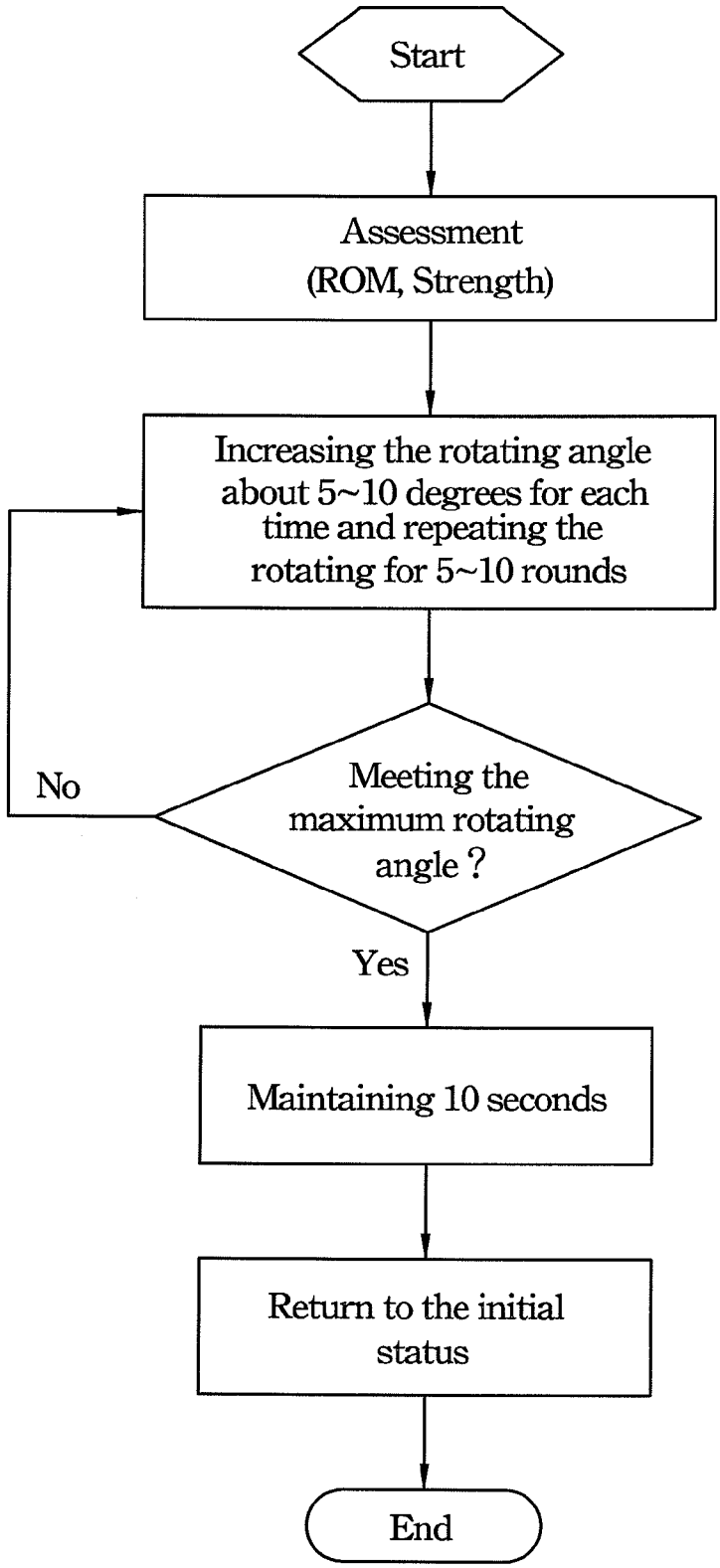
FIG. 5 is a rehabilitation method flow diagram of the present invention.

FIG. 5 is a rehabilitation method flow diagram of the present invention. The rehabilitation apparatus of the present invention can perform a passive rehabilitation process or an active rehabilitation process. When the passive rehabilitation process is performed, the user's body segment A is kept in a relaxation condition and engaged in the rotary housing 200, and the actuator 300 rotates the rotary housing 200 to guide the user to perform rehabilitation movements. First, the condition of the user's body segment A is assessed, such as the full range of joint operations and the muscle tone thereof, to determine whether and to what extent the body segment A is allowed to perform rehabilitation movements, and to determine the largest allowable rotation angle of the rotary housing 200. Then, the actuator 300 drives the rotary housing 200 to rotate reciprocately in alternate clockwise and counter clockwise, wherein the rotation angle is increased gradually, such as 5~10 degrees each time. Each time when the rotation angle is increased, the rotating of the rotary housing 200 is repeated for 5~10 rounds. When the rotation angle of the rotary housing 200 is increased up to the largest allowable rotation angle, the rotary housing 200 maintains that angle for 10 seconds. Then, the rotary housing 200 returns to the initial position and repeats the aforementioned rehabilitation process. In the passive rehabilitation process, the torque detector 400 continuously detects the torque input to assess the passive rigidity and the muscle tone of the user's body segment A and to determine whether the assistive torque provided by the rehabilitation apparatus is too large thereby protecting the user from damage or injury. Therefore, the rehabilitation apparatus of the present invention can simulate the therapist's rehabilitation method to increase the user's range of motion (ROM) and to reduce the passive rigidity and the muscle tone of the body segment A.

Referring to FIG. 1 again, when the active rehabilitation process is adopted, the display 510 of the control unit 500 displays the trace point, and the user can voluntarily rotate the rotary housing 200 to follow the trace point. In the active rehabilitation process, the actuator 300 applies resistive or assistive torque to the user's body segment A, namely the rotating direction of the actuator 300 is the same as or different from the voluntary rotating direction of the user's body segment A, thereby assisting or resisting the rotation of the user's body segment A. In this way, the strength of the user's body segment A is increased, and further the user's movement disorders is ameliorated.

Therefore, the rehabilitation apparatus can simulate the therapist's rehabilitation method and guide the user to perform rehabilitation movements for a long period of time, thereby saving labor and time, and the torque input of the user's body segment can be recorded to assess the degree of rehabilitation, thereby setting up a objective quantitative index for clinical rehabilitation assessment. Besides, the rehabilitation apparatus may be used to perform either the passive rehabilitation process or the active rehabilitation process according to the user's condition, thereby significantly enhancing the rehabilitation effect.

As is understood by a person skilled in the art, the foregoing embodiments of the present invention are strengths of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A rehabilitation apparatus, comprising:

a supporting housing;

a rotary housing slidably mounted to the supporting housing, wherein the rotary housing has a gear-like portion formed on the outer surface thereof;

at least one engagement member provided in the rotary housing for engaging a user's limb or body segment;

an actuator fixedly mounted to the supporting housing for rotating the rotary housing, wherein the actuator has a driving shaft and an actuating gear disposed at one end of the driving shaft and meshed with the gear-like portion of the rotary housing;

a control unit electrically connected to the actuator, wherein the control unit controls the actuator to rotate the rotary housing;

a torque detector disposed in the supporting housing and electrically connected to the control unit for detecting the torque exerted on the driving shaft and outputting a torque signal corresponding to the torque to the control unit, wherein the torque detector comprises:

a detecting circuit disposed on the driving shaft to detect the torque exerted on the driving shaft;

at least one inner ring sleeved on the driving shaft;

at least one outer ring sleeved on the inner ring and electrically connected to the control unit; and at least one conductive post disposed through the inner ring for electrically interconnecting the detecting circuit and the outer ring.

2. The rehabilitation apparatus as claimed in claim 1, wherein the rotary housing is an annular casing.

3. The rehabilitation apparatus as claimed in claim 1, wherein the supporting housing has annular grooves for slidably receiving the rotary housing.

4. The rehabilitation apparatus as claimed in claim 3, wherein the rotary housing have a plurality of rollers received in the annular grooves.

5. The rehabilitation apparatus as claimed in claim 1, wherein the actuator further has a motor to rotate the driving shaft.

6. The rehabilitation apparatus as claimed in claim 1, wherein the torque detector is disposed on the outer peripheral of the driving shaft.

7. The rehabilitation apparatus as claimed in claim 1, wherein the detecting circuit is formed by a plurality of strain gauges.

8. The rehabilitation apparatus as claimed in claim 7, wherein the torque detector includes an elastic element for biasing the conductive post against the outer ring or the detecting circuit.

9. The rehabilitation apparatus as claimed in claim 1, wherein the control unit is a computer apparatus.

10. The rehabilitation apparatus as claimed in claim 1, wherein the control unit is a programmable control chip.

11. The rehabilitation apparatus as claimed in claim 1, wherein the actuation of the actuator is controlled by the control unit according to the torque exerted on the driving shaft.

12. The rehabilitation apparatus as claimed in claim 1, further comprising a display to display a trace point adapted to be tracked by a user to perform a trajectory tracking task.

* * * * *